US007810854B2

(12) United States Patent
Hodge et al.

(10) Patent No.: US 7,810,854 B2
(45) Date of Patent: Oct. 12, 2010

(54) TRASH CONTAINER LOCKING APPARATUS

(75) Inventors: Allan M. Hodge, San Diego, CA (US); Anthony A. Hodge, San Diego, CA (US)

(73) Assignee: Hodge Products, Inc., El Cajon, CA (US)

( * ) Notice: Subject to any disclaimer, the term of this patent is extended or adjusted under 35 U.S.C. 154(b) by 795 days.

(21) Appl. No.: 11/736,734

(22) Filed: Apr. 18, 2007

(65) Prior Publication Data

US 2008/0257887 A1 Oct. 23, 2008

(51) Int. Cl.
*E05C 19/00* (2006.01)
*B65D 45/00* (2006.01)

(52) U.S. Cl. ..... 292/259 R; 292/336.3; 292/DIG. 11; 220/315; 220/810; 220/908

(58) Field of Classification Search ..... 292/259 R, 292/336.3, DIG. 11; 220/315, 810, 908
See application file for complete search history.

(56) References Cited

U.S. PATENT DOCUMENTS 3,011,666 A 12/1961 Dempster et al.
3,315,828 A 4/1967 Dubo
3,651,786 A * 3/1972 Patterson et al. ..... 119/481
3,665,736 A * 5/1972 Wilson ..... 70/78
3,687,317 A 8/1972 Gagel
3,709,389 A 1/1973 Steltz
3,989,162 A 11/1976 Hodge et al.
3,994,415 A 11/1976 Hodge
4,014,457 A 3/1977 Hodge
RE29,494 E 12/1977 Hodge
4,098,429 A 7/1978 Hodge
4,148,411 A 4/1979 Hodge et al.
4,155,584 A 5/1979 Pracchia
4,182,530 A 1/1980 Hodge
4,198,087 A 4/1980 Cornell et al.

(Continued)

FOREIGN PATENT DOCUMENTS

GB 2177683 A * 1/1987

OTHER PUBLICATIONS

Hodge Products, Inc., Website advertisement for Bar-Lok, Retrieved from the internet: http://www.lidlok.com/Bar_Lok.htm (May 17, 2001).

*Primary Examiner*—Carlos Lugo
(74) *Attorney, Agent, or Firm*—Procopio, Cory, Hargreaves & Savitch LLP

(57) ABSTRACT

A locking apparatus for releasably securing the lid of a trash container in a closed position has a locking arm with an elongate central portion for extending across the closed lid and bent end portions pivotally mounted on opposite sides of the container via pivot brackets which allow the arm to be pivoted between a first position extending across the closed lid of the trash container and a second position extending across the front wall of the container. The pivot bracket on one side is part of a locking device which has first and second locking formations on opposite sides of the pivot bracket, and the bent end portion of the arm on that side is releasably locked to the first locking formation by a locking member such as a padlock when the arm is in the first position and releasably locked to the second locking formation by the same member when the arm is in the second position.

16 Claims, 5 Drawing Sheets

U.S. PATENT DOCUMENTS

| | | | | |
|---|---|---|---|---|
| RE30,890 | E | 3/1982 | Hodge | |
| 4,424,740 | A | 1/1984 | Gwathney | |
| 4,520,945 | A | 6/1985 | Hodge | |
| 4,955,501 | A | 9/1990 | Hodge | |
| 5,015,021 | A | 5/1991 | Wyson et al. | |
| 5,025,721 | A | 6/1991 | Spiers | |
| 5,029,724 | A | 7/1991 | Serio | |
| 5,042,856 | A | 8/1991 | Goodman | |
| 5,085,341 | A | 2/1992 | Hodge | |
| 5,090,753 | A | 2/1992 | Goodman | |
| 5,094,358 | A | 3/1992 | Serio, Sr. | |
| 5,094,487 | A | 3/1992 | Drewry | |
| 5,118,000 | A | 6/1992 | Howell et al. | |
| 5,135,129 | A | 8/1992 | Joly | |
| 5,149,153 | A | 9/1992 | Drewry et al. | |
| 5,201,434 | A | 4/1993 | DeVivo | |
| 5,213,382 | A | 5/1993 | Dawdy | |
| 5,224,743 | A | 7/1993 | Dawdy et al. | |
| 5,224,744 | A | 7/1993 | Michelutti | |
| 5,415,314 | A | 5/1995 | McCollum | |
| 5,419,598 | A | 5/1995 | Kreitzer | |
| 5,474,341 | A | 12/1995 | Putman | |
| 5,599,050 | A | 2/1997 | Tinsley | |
| 5,662,364 | A | 9/1997 | Reeb et al. | |
| 5,683,126 | A | 11/1997 | DeVivo et al. | |
| 5,738,395 | A | 4/1998 | Probst | |
| 5,772,061 | A | 6/1998 | Lowe | |
| 5,772,264 | A | 6/1998 | Bettenhausen | |
| 5,997,052 | A | 12/1999 | Reeb et al. | |
| 6,267,260 | B1 | 7/2001 | Lyons | |
| 6,276,562 | B1 | 8/2001 | Hodge et al. | |
| 6,290,093 | B1 | 9/2001 | Obriot et al. | |
| 6,733,053 | B2 | 5/2004 | Hodge et al. | |
| 7,234,327 | B2 * | 6/2007 | Howes | 70/159 |
| 2002/0078720 | A1 | 6/2002 | Watts | |

* cited by examiner

TRASH CONTAINER LOCKING APPARATUS

BACKGROUND

1. Field of the Invention

The present invention relates to a trash container locking apparatus and method for releasably locking a trash bin lid in a closed position.

2. Related Art

Owners of large size or commercial trash bins as used for businesses, stores, apartments, and the like often experience difficulty in preventing unauthorized use of the bins. Waste disposal costs are increased by unauthorized individuals dumping trash into the bins. In view of this, various locking systems have been proposed in the past for preventing dumping of trash in such bins by unauthorized individuals. However, such locking systems often make it difficult for authorized users to gain access to the bin, and also cause difficulty to refuse collectors.

Some trash bins have automatic locks which release when the bin is inverted to dump trash, but re-lock automatically when the bin is returned to an upright position and the lid is closed. This is hazardous to children who may be playing in the area, as well as homeless individuals, who may become locked in the bin after the lid is closed. There is also a risk that children may become accidentally locked in such bins while playing.

U.S. Pat. No. 5,213,382 of Dawdy et al. describes a locking mechanism for a refuse container which has a locking bar pivotally attached to the container and movable between a locked position preventing opening of the container lid and an open position in which it is rotated out of the way of the lid. When a locking fixture on the mechanism is engaged, the locking bar cannot be manually pivoted, but it can be pivoted by the force of a collection truck boom. The lock may be disengaged by a key allowing manual pivoting of the locking bar into the open position. U.S. Pat. No. 5,029,724 of Serio describes a U-shaped locking member which is pivoted to the side walls of a container. The member pivots over the lid in order to lock the lid closed. A locking mechanism holds the U-shaped member in this position.

Other trash bin locking systems are known which involve a bar pivotally mounted on the container and rotatable between a position extending over the lid to hold it closed, and a position rotated down against the front wall of the container, leaving the lid free to open. The bar is normally locked by a padlock or the like in the closed position. A problem with such a system is that the bar pivots freely when released, such that when the bin is inverted to dump trash into a trash truck, the bar tends to drop down and get in the way of the lid or the trash itself. Also, such a system is still subject to the risk of homeless individuals entering the bin to sleep if the lid is left open, and then closing the lid. Authorized individuals may then rotate the bar over the lid and lock it in place, trapping the person in the trash bin.

Another problem with bar locking systems is that trash bins come in various sizes, so that the bars must be custom-made for the specific containers or must be adjustable to accommodate different container sizes. In one known system, separate left and right arms are provided for pivotally mounting on opposite side walls of a trash container adjacent the lid and the front end wall. One of the arms has an opening for alignment with a padlock holder when rotated into a locked position. The on-site installer must first attach the arms to the opposite ends of the container, and then cut a pipe to the desired length for spanning the front wall of the container between the free ends of the two arms. At that point, the pipe must be welded to the arms. This is a fairly labor intensive process which is subject to error. It also has the problem that the pipe is free to flop around, potentially catching on the lid and preventing it from opening, when the container is inverted in order to dump trash.

In our prior U.S. Pat. No. 6,733,053, a trash container locking apparatus is described in which a locking arm is configured to extend across the width of a trash container adjacent the upper, front end of the container, and has bent end portions pivotally mounted on opposite sides of the container. This allows the arm to be pivoted between a first position extending over the closed lid of the container to hold it closed, and a second position extending across the front of the container so that the lid can be freely opened. The arm is lockable in both the first and second position by means of spaced locking plates on one side wall of the container which are positioned for engagement with locking flanges on the bent end portion of the locking arm when the arm is in the first and second position, respectively. One problem with this arrangement is that there are three separate components to be mounted on the side wall of the trash container, specifically the pivot bracket and the first and second locking plates, and these must be positioned precisely relative to one another for proper operation of the locking apparatus. This makes retrofitting of existing trash containers somewhat difficult.

Therefore, what is needed is a system and method that overcomes these significant problems found in the conventional systems as described above.

SUMMARY

Embodiments described herein provide for an apparatus and method for locking a trash container to restrict access to the container.

According to one embodiment, a trash container locking apparatus comprises an elongate locking arm configured to extend across the top of the closed lid of a trash container in a first, locking position and across the front wall of the trash container in a second, lid release position, the arm having at least one bent end, an elongate locking device or plate having a pivot mount defining a first pivot axis pivotally secured to the bent end of the locking arm and configured for mounting on one side wall of a trash container to allow pivoting of the locking bar about the pivot axis between the first and second positions, the locking plate having a first locking portion projecting in a first direction from the pivot mount and a second locking portion projecting in a second direction from the pivot mount, the bent end of the arm having first and second locking flanges, the first locking flange being configured to engage the first locking portion of the locking plate in the first position of the locking arm, and the second locking flange being configured to engage the second locking portion of the locking plate in the second position of the locking arm, whereby the first locking flange and locking portion can be secured together to lock the locking arm in the first position and the second locking flange and locking portion can be secured together to lock the locking arm in the second position.

By combining the locking arm pivot mount with the two locking portions to provide a one piece component, the apparatus can be relatively easily installed on a trash container since only one component is mounted on each side of the container.

In one embodiment, the first and second locking portions each have a padlock opening and the first and second locking flanges are adapted for face-to-face engagement with the respective locking portions in the first and second position, respectively, of the locking arm. Each locking flange has an opening configured for alignment with the respective locking portion opening in the respective first and second locking arm positions.

When the locking arm is in the first position extending over the top of the trash container lid in its closed position, and the first locking flange is locked to the first locking portion of the locking member, unauthorized individuals are unable to open the lid of the trash container in order to dump trash. Authorized individuals are provided with a key to unlock the locking arm when they wish to deposit trash in the container. When the locking arm is locked in the second position extending across the front of the container, the lid can be opened freely, and the locking arm is held away from the open end of the container when the container is inverted in order to dump trash into a trash collection truck.

In one embodiment, the locking member is a bent plate having a generally flat, intermediate portion which has integral or welded pivot brackets projecting in one direction from the plate, the bent end of the locking arm being pivotally mounted on a pivot pin extending between the pivot brackets. The locking flanges extend in opposite directions from the bent end of the locking arm at a location spaced from the pivot brackets in a direction transverse to the pivot axis and to the bent end axis. The locking portions comprise a first end portion of the plate which is bent at a first angle to the intermediate portion and a second end portion of the plate which is bent at a second angle to the intermediate portion, whereby the first and second locking flanges rest flat against the first and second plate end portions when the locking arm is in the first and second position, respectively.

The locking arm has a second bent end in one embodiment, and a pivot bracket is pivotally secured to the second bent end portion and configured for mounting on the opposite side wall of a trash container to the elongate locking device.

The locking apparatus can be mounted on a trash container relatively easily since only two components are mounted on the opposite side walls of the container, specifically a simple pivot mount on one side, and a combined pivot mount and locking device on the opposite side.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an apparatus and method for locking a trash container with the lid in the closed position. For example, one apparatus as disclosed herein allows for a pivotally mounted locking arm to be locked in either a position extending across the lid of a trash container to hold the lid closed or in a position extending across the front of the container so that the lid can be opened to dump trash into the container or to allow the container to be emptied into a trash removal truck.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
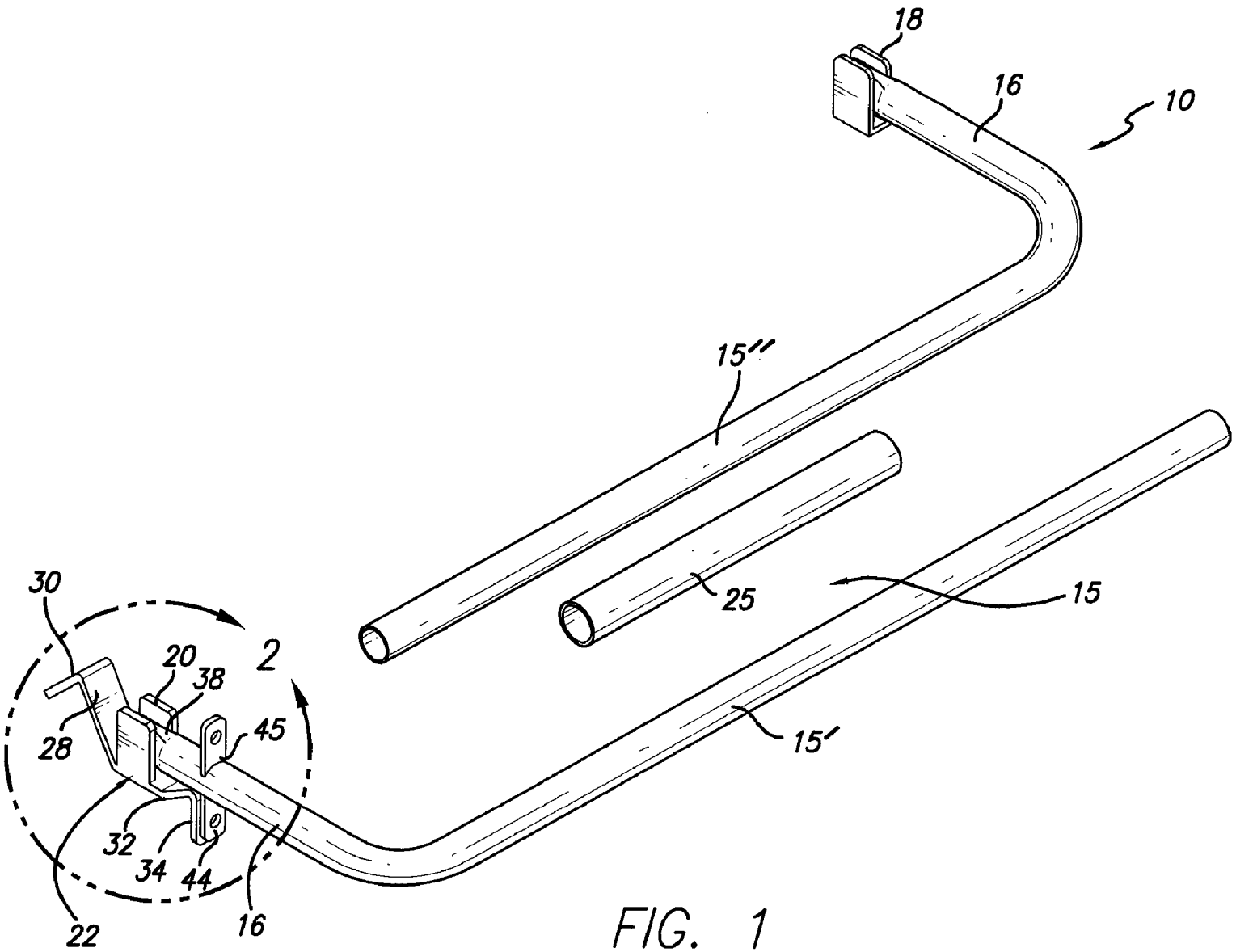
FIG. 1 is a perspective view of a trash container locking apparatus according to one embodiment.
Figure 2:
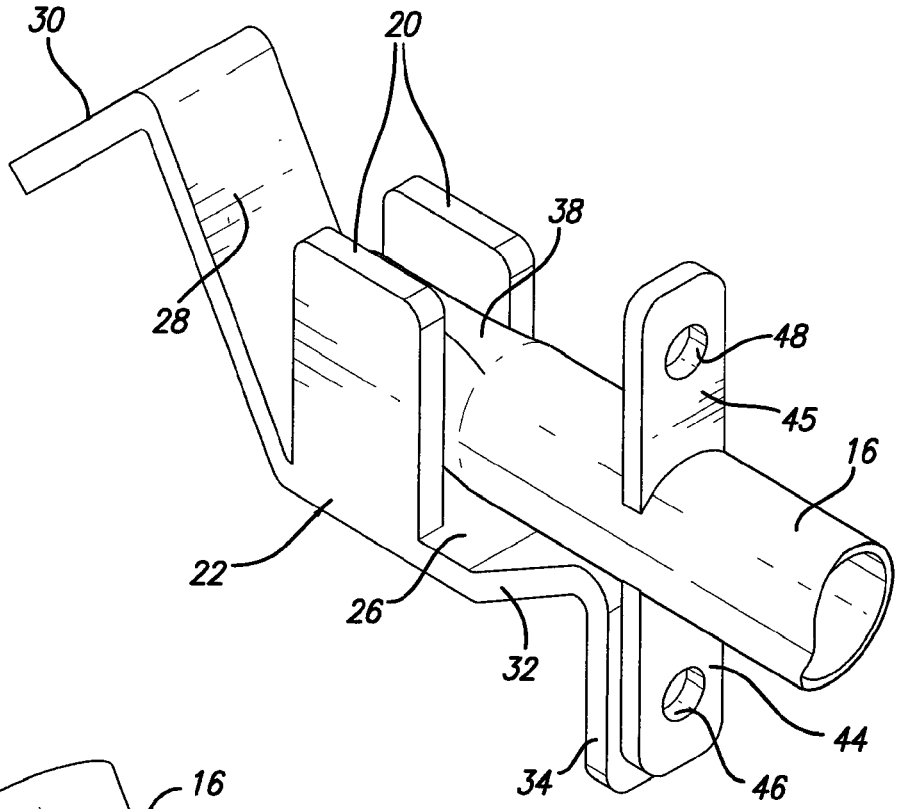
FIG. 2 is an enlarged view of the combined locking device and pivot mount in the circled area of FIG. 1, showing the locking arm in one position.
Figure 3:
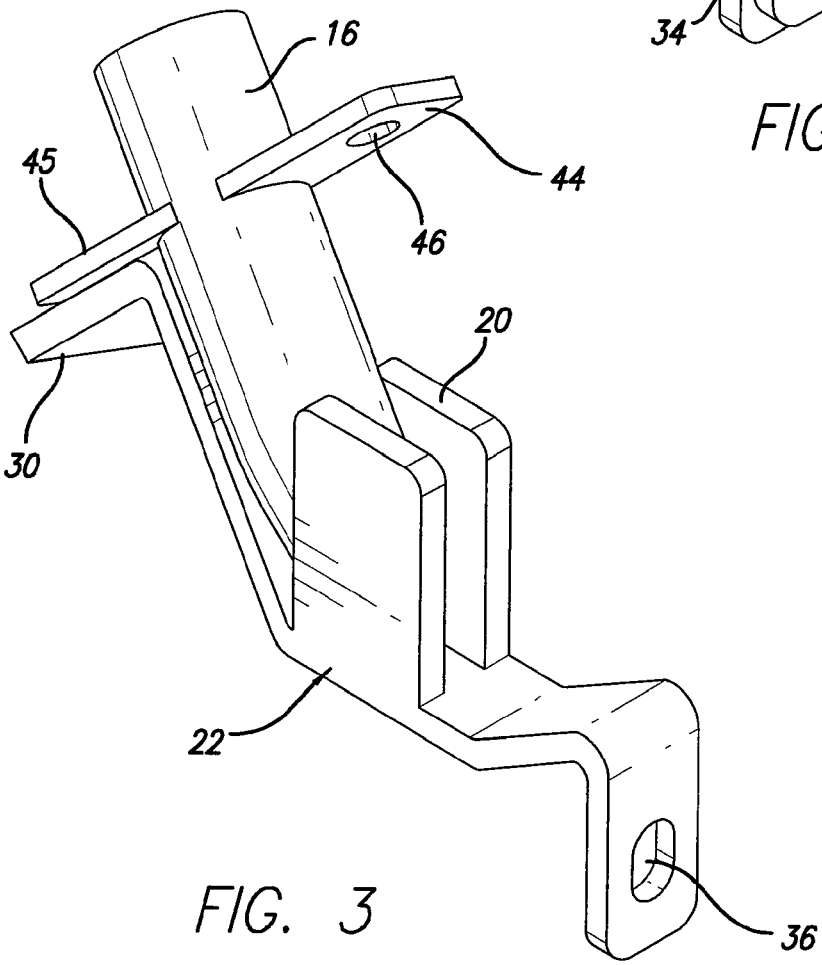
FIG. 3 is a view similar to FIG. 2 showing the locking arm pivoted into another locking position.

FIGS. 1 to 3 illustrate a trash container locking apparatus 10 according to one embodiment, while FIGS. 4A, 4B, 5A, and 5B illustrate the apparatus installed at the front end of a trash container 12 adjacent the upper end opening of the container, with the lid 14 of the container shown in the closed position. The apparatus 10 basically comprises a locking arm 15 having an elongate central portion of adjustable length and opposite end portions 16 bent perpendicular to the central portion, an end of one bent portion 16 pivotally mounted in a pivot mounting bracket 18 and an end of the other bent portion pivotally mounted in a pivot mounting bracket 20 of a combined pivot mount and locking device 22.

Arm 15 is a metal pipe of round or square tubing in the illustrated embodiment, although it may be a solid metal arm or the like in alternative embodiments. In one embodiment, the diameter of arm 15 is of the order of 0.5 inches to 1 inch, with the diameter being 0.75 inches in one example. In the illustrated embodiment, the arm is split into two halves 15' and 15" at the center of the central portion, with the end of each half telescopically engaged in the respective ends of a central sleeve or collar 25. This is to allow for adjustment of the overall length of the central portion when the arm is installed on a trash container, so that it can be readily adapted to containers of different widths. Once the central portion length has been adjusted and the pivot bracket 18 and pivot locking device secured to the opposite side walls of a trash container, the two halves of the pipe can be suitably welded to the opposite ends of sleeve 25.

Figure 5A:
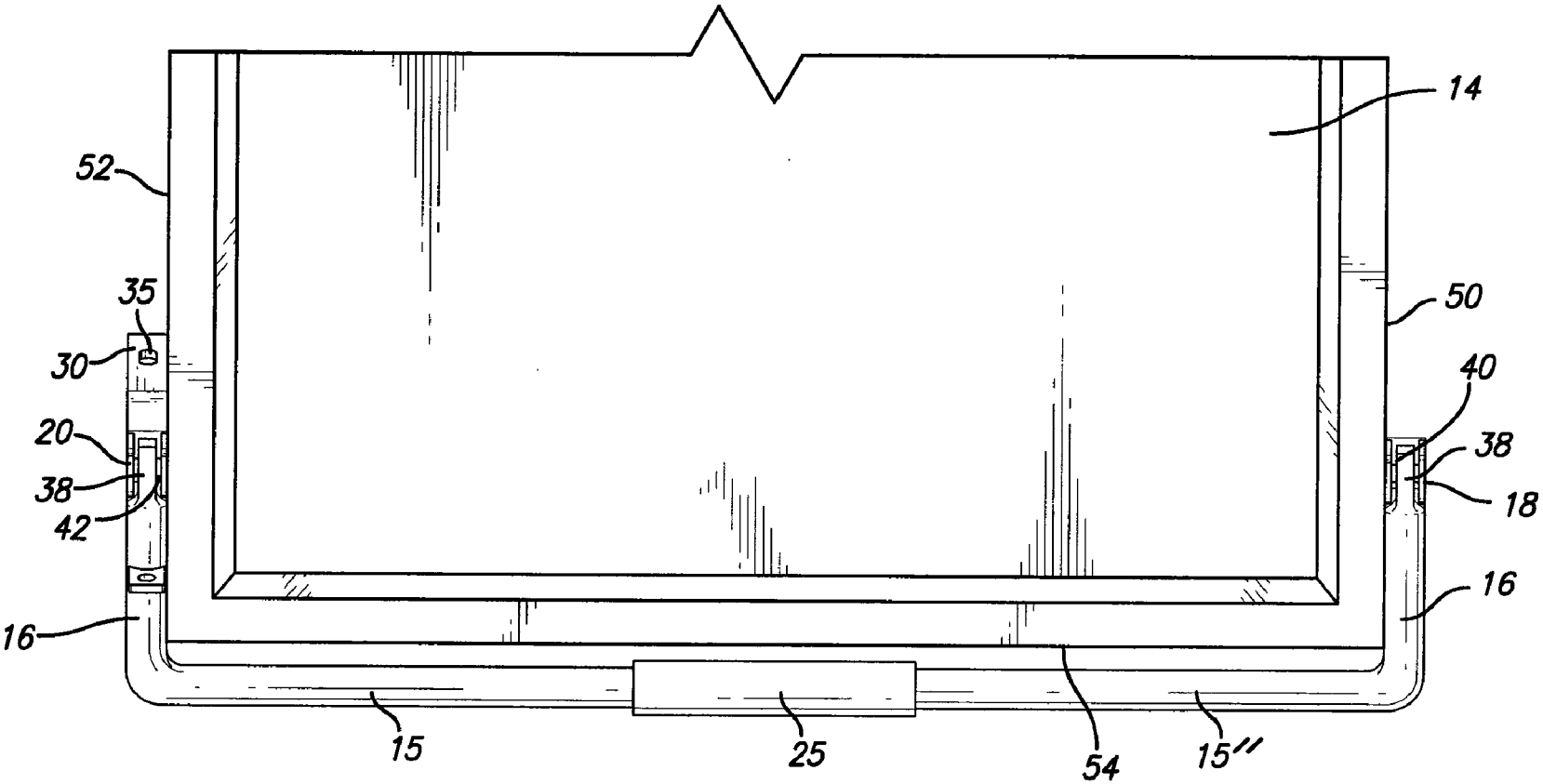
FIG. 5A is a top plan view of the front end of a trash container with the locking apparatus mounted on the container and the locking arm in the released position of FIG. 4A.
Figure 5B:
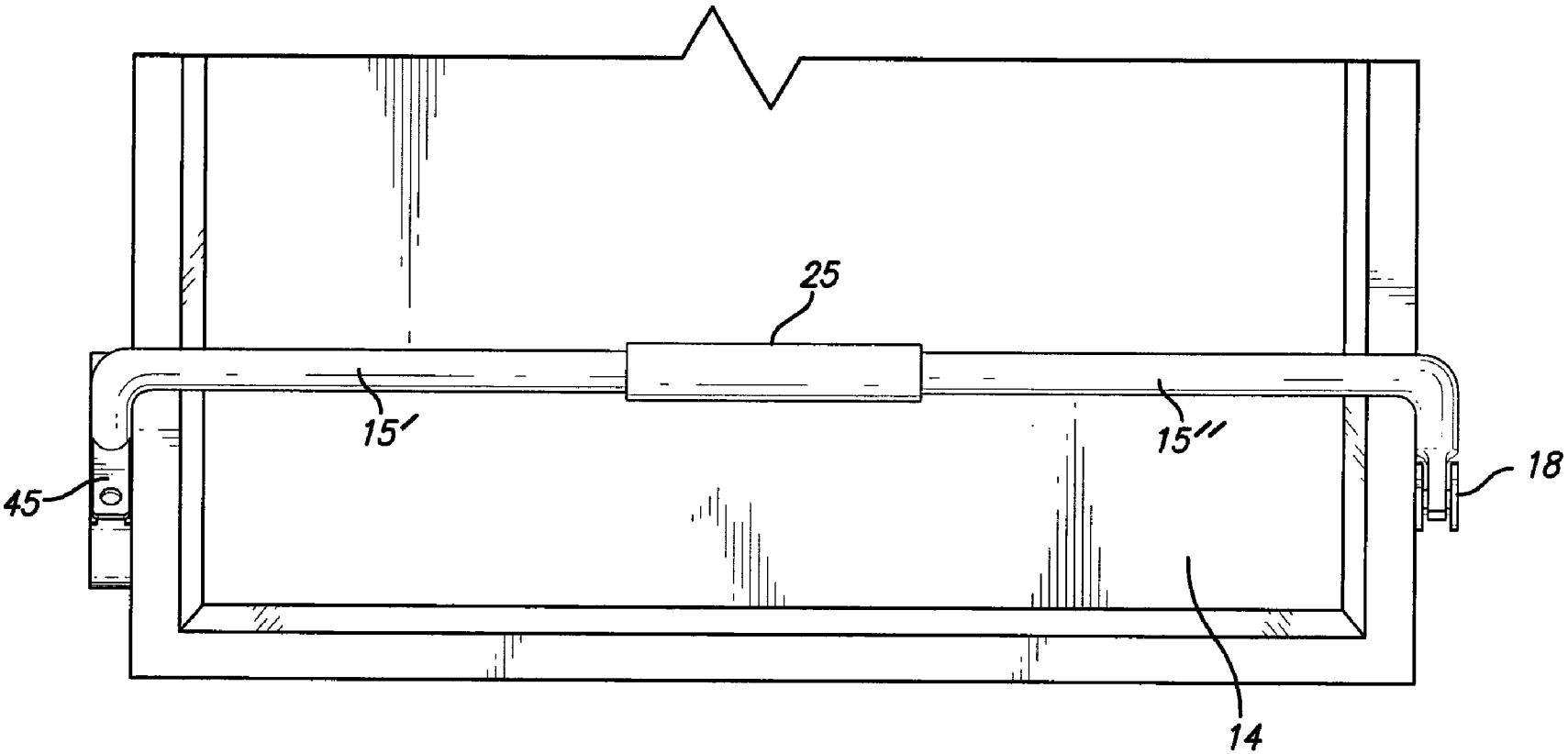
FIG. 5B is a top plan view similar to FIG. 5A but with the locking arm in the locking position.

The combined pivot mount and locking device 22 is illustrated in more detail in FIGS. 2 and 3. Device 22 in one embodiment comprises an elongate plate which is bent to provide a central or intermediate, generally flat pivot mount portion 26 from which opposite sides of the pivot bracket 20 extend in a first, generally upward direction. The plate and pivot bracket may be formed integrally or the pivot bracket may be secured to the plate by welding or the like. An upwardly angled portion 28 extends from one end of the pivot mount portion 26, and a downwardly angled locking portion or formation 30 extends from portion 28 to one end of the plate. An upwardly angled portion 32 extends from the opposite end of pivot mount portion 26, followed by a downwardly bent locking portion or formation 34 which is substantially perpendicular to pivot mount portion 26 and extends to the other end of the plate. A first slot 35 is provided in the locking portion 30, as best seen in FIG. 5A, and a second slot 36 is provided in the locking portion 34 (see FIG. 3).

The pivoted end 38 of each bent end 16 of the arm 15 is flattened and rotatably mounted on a respective pivot pin 40,42 (see FIG. 5A) which extends between the opposite sides of the pivot brackets 18 and 20, respectively. The arrangement is such that the ends 38 have some free play between the opposite sides of the pivot brackets and can slide along the length of pin 40,42 between the sides of the pivot brackets, so that the arm is less likely to deform or bend on impacts, and less likely to jam or become non-pivotable if it is deformed. In one embodiment, each pivot pin 40,42 was at least 0.25 inches longer than necessary to provide for free play of the ends 38 along the pins to preclude or reduce the risk of binding if the arm becomes deformed by impact at a later date.

The end portion 16 of the locking arm 15 which engages the locking device 22 has a downwardly projecting locking flange 44 and an upwardly projecting locking flange 45 spaced from the pivoted, flattened end 38 of the bent end portion 16, as best illustrated in FIG. 2. Each flange has a lock opening 46,48 respectively. Openings 46, 48 may be slots rather than holes in an alternative embodiment.

In order to install the locking apparatus of FIGS. 1 to 3 on a trash container, the length of the central portion of arm 15 is adjusted to span the width of the container, and the pivot bracket 18 and combined pivot bracket and locking device 22 are mounted on opposite sides 50,52 of the container adjacent the upper opening of the container and the front wall 54 of the container, with the pivot axes of the two pivot brackets aligned. The bracket 18 and device 22 are mounted at an appropriate position such that the central portion of the arm can extend across the front wall of the container with some free play, and can extend over the top of the lid of the container when closed. The brackets may be secured by welding, bolts, or other fasteners. The length of the central portion is adjusted and the two halves of the arm are then welded to the opposite ends of the adjustment sleeve 25. Arm 15 can then be pivoted up and down between a first, locking position in which it extends over the top of the closed lid 14 of the container, as in FIGS. 4B and 5B, and a second, lid released position in which it extends across the front wall or front rim 54 of the container, as in FIGS. 4A and 5A. FIG. 2 shows the position of the arm end portion 16 relative to locking device 22 when the arm is in the second position, while FIG. 3 shows the position of arm end portion 16 when the arm is in the first, container locking position.

Figure 4A:
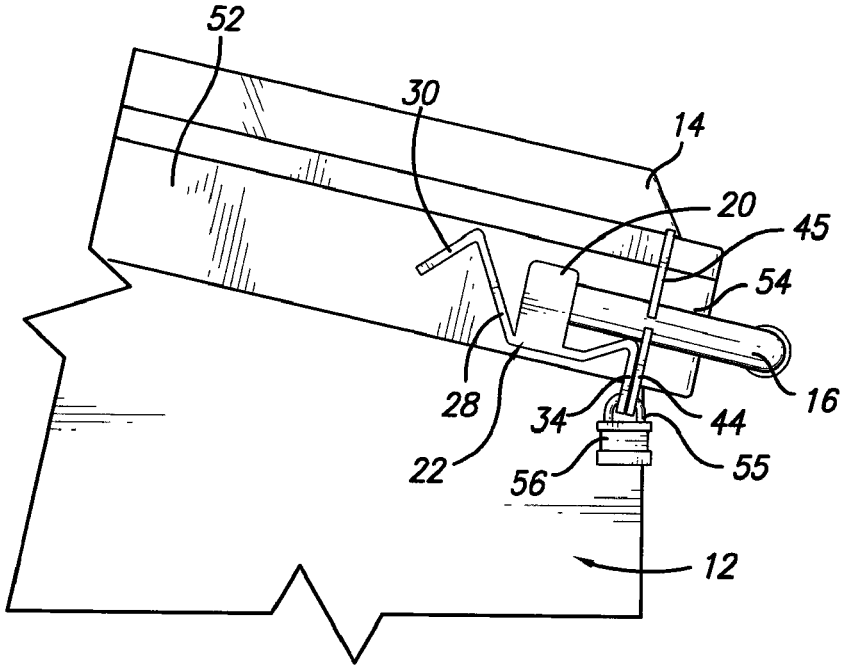
FIG. 4A is a side elevation view of the trash container similar to FIG. 4A but with the locking arm in a released position extending across the front of the container and padlocked to the locking device in the position of FIG. 2.

When the arm 15 is in the lid released position illustrated in FIGS. 2, 4A, and 5A, it extends across the front wall 54 just below the rim of the container opening, and the end portions 16 are pivoted into a forwardly extending orientation, with downwardly extending flange 44 resting against the locking end portion 34 of the locking device or plate, as best seen in FIG. 2. In this position, the opening 46 in flange 44 and the slot 36 in the locking end portion 34 are aligned. The shackle 55 of padlock 56 can then be inserted through the aligned openings and locked in the body of the padlock in the closed position, as illustrated in FIG. 4A. This prevents movement of the arm 15 from the lid released position, so that the lid 14 of the container may be freely opened and closed.

Figure 4B:
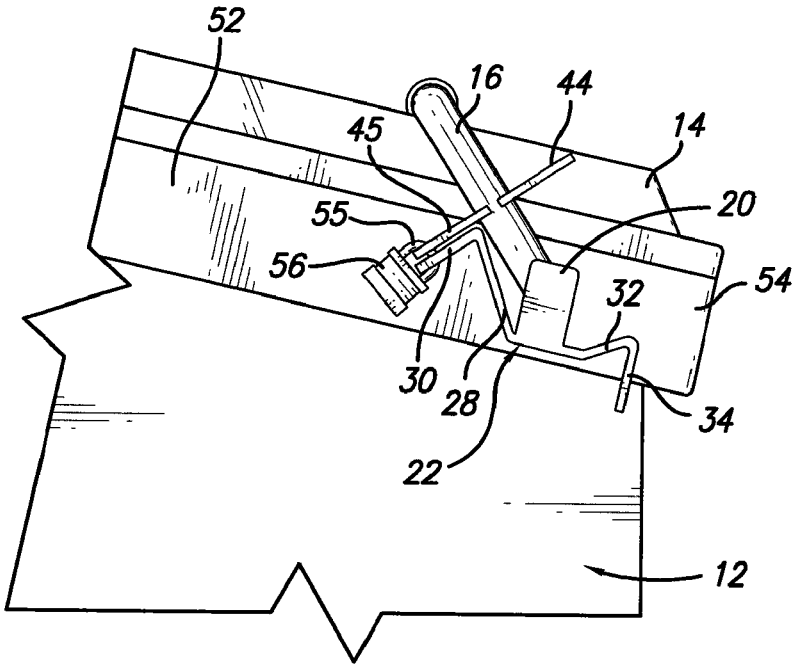
FIG. 4B is side elevation view of part of a trash container with the locking apparatus mounted on the container and the locking arm extending over the top of the container lid and locked to the locking device in the position of FIG. 3.

If the container lid is to be locked in the closed position, to prevent access to the interior of the container, the padlock 56 is unlocked and released from openings 46,36. When the padlock is released, arm 15 may be rotated in an anti-clockwise direction from the position of FIGS. 2, 4A and 5A into the locking position of FIGS. 3, 4B and 5B, in which the upper flange 45 on end portion 16 rests against the locking end portion 30 of the locking device 22. In this position, the central portion of arm 15 extends across the top of the container lid 14 and prevents opening of the lid. In the position of FIG. 3, the opening 48 in flange 45 is aligned with the slot 35 in the locking end portion 30. In this position, the shackle 55 of padlock 56 can be inserted through the aligned openings 48 and 35, as illustrated in FIG. 4B, and locked in the closed position. This prevents movement of the arm 15 from the closed and locked position.

The distance of the flanges 44, 45 from the pivoted end of arm end portion 16 is determined based on the distance of the locking end portions 34, 30, respectively, from the pivot, and is adapted so that the flanges 44, 45 rest in face to face engagement against the respective end portions or plates 34, 30 when the locking bar is in the open and closed position of FIGS. 4A and 4B. In the illustrated embodiment, these distances are equal so that the flanges 44, 45 extend in opposite directions from the same position on end portion 16, but the distance of each flange from the pivot may be different in other embodiments. In such embodiments, the relative lengths of portions 28 and 32 of the device 22 are adjusted appropriately so that the flanges 44,45 still rest against end portions 34, 30 when in the end positions of FIGS. 4A and 4B.

Each authorized user of the container, as well as the trash pick up personnel, is provided with a key for padlock 56. Normally, the lid of the container is closed, and the arm is locked in the closed position of FIGS. 4B and 5B. When an authorized user wishes to place some trash in the container, they unlock the padlock 56 and rotate the arm into the open position, with the flange 44 resting on end locking portion 34 of the locking plate. The lid can then be opened. The user then closes the lid and rotates the arm back into the closed and locked position of FIGS. 4B and 5B, returning the padlock to the position illustrated in FIG. 4B and locking it.

When a trash truck arrives in order to dump trash from the container 12, the operator or driver first unlocks the padlock 56, rotates the arm into the open position of FIGS. 4A and 5A, and locks the arm in this position. They can then activate the truck arms to lift the container and invert it in order to allow the lid to swing open and any trash in the container to be dumped into the truck. The pivoted arm is held in the open position during this process, preventing it from swinging down and impeding the trash dumping operation. The container is then returned to its upright position. Should the truck driver forget to close the container lid and re-lock the arm over the lid, the arm is locked open and cannot be moved over the lid to hold it closed. The only way it can be moved is for an authorized user to unlock the padlock 56 and release the arm so that it can be rotated up and locked over the closed lid.

In the past, homeless individuals or children playing would sometimes enter a trash container, and then move the lid into the closed position. This would not be a problem normally, since it would still be possible to move the lid aside in order to exit the container. However, an unlocked, pivoted locking bar could potentially be rotated over the lid in such situations, and even locked in place, by someone unaware of the presence of an individual inside the container. An individual may be dumped from a container into a trash truck in such situations, which is very hazardous. The locking system of this invention reduces the risk of such accidental locking of individuals into trash containers, since the trash truck operators lock the arm in the open position in order to dump trash, so that it cannot subsequently be rotated over the closed lid of the container unless the operator or another authorized individual actually unlocks the padlock, rotates the arm into the closed position, and re-locks the padlock. This makes it unlikely that the arm is left in an open, unlocked condition.

The one piece, combined pivot bracket and locking plate 22 can be installed on the container relatively easily, eliminating separate parts which must be aligned relative to one another before attaching to the side wall of the container. Although each locking mechanism in the illustrated embodiment comprises two flat or plate members in face-to-face engagement with aligned openings through which the shackle of a padlock extends, in alternative embodiments one of the two plate members (i.e. the locking end portion of the locking plate 22 or the locking flange on the bent end portion of arm 15) may be oriented to extend partially through a slot in the other plate member, and have an opening for receiving the shackle of a padlock to hold the two plate members together.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A locking apparatus for a trash container having a pivotal lid, comprising:

an elongate locking arm configured to extend across the top of the closed lid of a trash container in a first position and across the front wall of the trash container in second position;

the arm having first and second ends, wherein at least one of the ends has a bent end portion and first and second locking flanges spaced from the end of the arm and projecting in opposite directions from the bent end portion;

an elongate locking device configured for mounting on one side wall of the trash container, the locking device having first and second spaced locking formations configured to engage the first and second locking flanges, respectively, in the first and second positions of the arm;

a pivot mount on the locking device between the first and second locking formations;

the bent end portion being pivotally secured to the pivot mount for rotation about a pivot axis between the first and second positions;

wherein, when the arm is moved to the first position, the first locking flange is moved to contact the first locking formation, allowing the first locking flange to be secured to the first locking formation by a locking member, securing the arm in place and preventing pivotal movement of the lid; and wherein, when the arm is moved to the second position, the second locking flange is moved to contact the second locking formation, allowing the second locking flange to be secured to the second locking formation by the locking member, securing the arm in place and allowing pivotal movement of the lid.

2. The apparatus of claim 1, wherein the first and second locking formations each have a padlock opening and the first and second looking flanges are adapted for face-to-face engagement with the respective locking formations in the first and second position, respectively, of the locking arm, each locking flange having an opening configured for alignment with the respective locking formation opening in the respective first and second positions of the arm, whereby the locking member can be extended through the aligned openings in each locking arm position.

3. The apparatus of claim 2, further comprising a padlock having a shank for extending through the aligned openings in each locking arm position, and a key for releasing the shank from the locked position.

4. The apparatus of claim 1, wherein the locking device comprises an elongate plate having a pivot bracket projecting from one face of the plate at an intermediate position in the length of the plate, the pivot bracket comprising the pivot mount, the first locking formation comprising a first angled end portion of the plate and the second locking formation comprising a second angled end portion of the plate, each angled end portion having an opening for receiving the locking member.

5. The apparatus of claim 4, wherein the first locking flange is positioned for face-to-face engagement with the first angled end portion of the plate in the first arm position and the second locking flange is positioned for face-to-face engagement with the second angled end portion of the plate in the second arm position, each locking flange having an opening for alignment with the opening in the respective angled end portion of the plate when the arm is in the first or second position, respectively.

6. The apparatus of claim 4, wherein the plate has an intermediate flat portion from which the pivot bracket projects in a first direction, and an angled portion extending between one end of the intermediate flat portion and the first angled end portion of the plate, the angled portion and first angled end portion together forming a generally V-shape having an apex pointing in the first direction.

7. The apparatus of claim 6, wherein the plate has a second angled portion extending between the opposite end of the intermediate flat portion and the second angled end portion of the plate, the second angled portions together forming a shape having an apex pointing in the first direction.

8. The apparatus of claim 7, wherein the second angled end portion extends substantially perpendicular to the bent end portion of the arm when the arm is in the second position.

9. The apparatus of claim 1, wherein the arm has a second bent end portion and a pivot bracket pivotally connected to the second bent end portion of the arm and configured for mounting on an opposite side wall of a trash container, the pivot mount and pivot bracket having aligned pivot axes.

10. A lockable trash container assembly comprising:

a trash container having a front wall, a rear wall, opposite side walls, and an open upper end;

at least one pivotal lid on the trash container moveable between an open position exposing the open upper end of the container and a closed position closing the open upper end of the trash container;

first and second pivot brackets mounted on the opposite side walls of the container;

an arm having an elongate central portion and opposite first and second bent end portions pivotally mounted on the first and second pivot brackets, respectively, whereby the arm is pivotable between a first position in which the central portion extends across the closed lid of the container and a second position in which the end portions extend forwardly and the central portion extends across the front wall of the container;

at least the first pivot bracket comprising part of a locking device having first and second locking formations extending in opposite directions from the first pivot bracket;

at least the first bent end portion of the arm having first and second locking flanges;

the first locking flange engaging with the first locking formation of the locking device when the arm is in the first position, allowing the first locking flange to be secured to the first locking formation by a locking member, securing the arm in place and preventing pivotal movement of the lid; and the second locking flange engaging with the second locking formation of the locking device when the arm is in the second position, allowing the second locking flange to be secured to the second locking formation by the locking member, securing the arm in place and allowing pivotal movement of the lid.

11. The assembly of claim 10, wherein the first and second locking flanges are configured for face-to-face engagement with the first and second locking formations in the first and second positions, respectively, of the arm, the first locking flange and locking formation having a first pair of openings which are aligned when the arm is in the first position and the second locking flange and locking formation having a second pair of openings which are aligned when the arm is in the second position, whereby the locking member can extend through the first pair of openings in the first position of the arm and can extend through the second pair of openings in the second position of the arm.

12. The assembly of claim 11, further comprising a padlock having a shank for extending through the aligned openings in each locking arm position, and a key for releasing the shank from the locked position.

13. The assembly of claim 10, wherein the locking device comprises an elongate plate, the first pivot bracket projecting from one face of the plate at an intermediate position in the length of the plate, the first locking formation comprising a first angled end portion of the plate and the second locking formation comprising a second angled end portion of the plate, each angled end portion having an opening for receiving the locking member.

14. The assembly of claim 13, wherein the plate has an intermediate flat portion from which the pivot bracket projects in a first direction, and an angled portion extending between one end of the intermediate flat portion and the first angled end portion of the plate, the angled portion and first angled end portion together forming a generally V-shape pointing in the first direction.

15. The assembly of claim 14, wherein the plate has a second angled portion extending between the opposite end of the intermediate flat portion and the second angled end portion of the plate, the second angled portions together forming a shape having an apex pointing in the first direction.

16. A method of locking a trash container, comprising:

mounting first and second pivot brackets on opposite side walls of a trash container adjacent the front wall and upper end opening of a trash container, at least the first pivot bracket being formed with oppositely directed, first and second locking formations;

pivotally mounting opposite first and second bent end portions of a locking arm on the respective first and second pivot brackets such that the arm can be pivoted between a first position extending across the closed lid of the trash container to prevent opening of the lid and a second position extending across the front wall of the container;

closing the lid of the container;

moving the arm into the first position extending across the closed lid, whereby a first locking flange on the first bent end portion of the arm is positioned adjacent to the first locking formation;

securing the first locking flange to the first locking formation with a locking member, whereby the arm is locked in the first position and the lid cannot be opened;

releasing the locking member from the first locking flange and first locking formation;

moving the arm into the second position whereby a second locking flange on the first bent end portion of the arm is positioned adjacent to the second locking formation;

securing the second locking flange to the second locking formation with the locking member, whereby the arm is locked in the second position allowing the lid to be opened; and opening the lid in order to dump trash out of the container or dump trash into the container.

* * * * *